United States Patent [19]

Lahman

[11] Patent Number: 4,832,336

[45] **Date of Patent: * May 23, 1989**

[54] EXERCISE DEVICE

[76] Inventor: Thomas E. Lahman, 5133 N. 32nd Pl., Phoenix, Ariz. 85018

[ * ] Notice: The portion of the term of this patent subsequent to May 24, 2005 has been disclaimed.

[21] Appl. No.: 195,006

[22] Filed: May 17, 1988

[51] Int. Cl.[4] ..... A63B 21/00

[52] U.S. Cl. ..... 272/144; 272/134

[58] Field of Search ..... 272/117, 118, 134, 135, 272/138, 144, 129, 62, 130, 116, 145, 136, 137; 128/25 R, 69, 70; 269/4, 328

[56] References Cited

U.S. PATENT DOCUMENTS

| | | | |
|---|---|---|---|
| 3,817,243 | 6/1974 | Perrine | 128/57 |
| 4,188,029 | 2/1980 | Broner et al. | 272/62 |
| 4,286,782 | 9/1981 | Fuhrhop | 272/117 |
| 4,324,399 | 4/1982 | Rickey | 272/144 |
| 4,746,115 | 5/1988 | Lahman | 272/130 |

*Primary Examiner*—S. R. Crow

*Attorney, Agent, or Firm*—Warren F. B. Lindsley

[57] ABSTRACT

A multi-purpose exercising device which comprises an elongated frame having coplanar top and bottom surfaces and front and rear ends. A pivotally mounted support post is mounted at the rear end of the frame for providing the dual function of holding a pad positioned on the top of the frame at an elevated angular position or extending from the bottom of the frame to provide a support for the rear end of the frame. A biceps femoris attachment is detachably mounted on the rear end of the frame for holding a leg pad parallel with and spaced from the rear end of the frame. This leg pad is pivotally movable by an exerciser lying prone on the frame with legs encountering the leg pad. A controlled resistance means is attached to the leg pad for providing a controlled resistive force to the pivotal movement of the leg pad.

5 Claims, 1 Drawing Sheet

EXERCISE DEVICE

This application is an improvement over U.S. patent application Ser. No. 07/023,855, filed Mar. 9, 1987 now U.S. Pat. No. 4,746,115 and entitled EXERCISING DEVICE WITH CONTROLLED FORCE PATTERN, and more particularly, an improvement in the abdominal exercise bench shown therein.

BACKGROUND OF THE INVENTION

This invention is a dual-function exercise device intended to aid in the strengthening and development of abdominal muscles and, when linked to a source of resistance such as described in U.S. patent application Ser. No. 07/023,855 which is incorporated herein by reference, aids in the strengthening and development of the biceps femoris muscles.

DESCRIPTION OF THE PRIOR ART

There are numerous patents disclosing abdominal exercise devices, most common of which are variations of a rigid horizontal planar platform type whereupon the exerciser lies full length with his back in contact with the platform. One end of the platform has some manner of restraining the exerciser's feet. When in position on the platform with feet secured, the exerciser then "sits up" repeatedly. The end restraining the feet is often capable of being elevated in order to increase effort required to perform the "sit up". This form of apparatus is illustrated in U.S. Pat. Nos. 4,188,029 and 4,286,782. A variation of this apparatus is disclosed in U.S. Pat. Nos. 3,817,243 and 4,324,399. In these patent references, the exerciser's body from the knees up lies on the platform while the lower legs extend downward at a 90° angle. None of these references disclosed the compact, versatile abdominal muscle exerciser disclosed herein.

SUMMARY OF THE INVENTION

In accordance with the invention claimed, an improved compact and versatile abdominal muscle exercising and development apparatus is provided which can be converted to a biceps femoris exercising and development apparatus when linked to a source of resistance, such as that disclosed in the above identified patent application which is included herein by reference.

It is, therefore, one object of this invention to provide a new and improved exercise bench.

Another object of this invention is to provide a new and improved exercise bench as an abdominal muscle exerciser.

A further object of this invention is to provide an exercise bench that can be readily converted for use as a biceps femoris exerciser.

A still further object of this invention is to provide an exercise bench in a form that is collapsible to relatively compact dimensions from the opened or extended form required during use so that the apparatus will not occupy an undesirable large storage space when not in use.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described by reference to the accompanying drawings, in which.

DESCRIPTION OF THE PREFERRED EMBODIMENT

Figure 1:
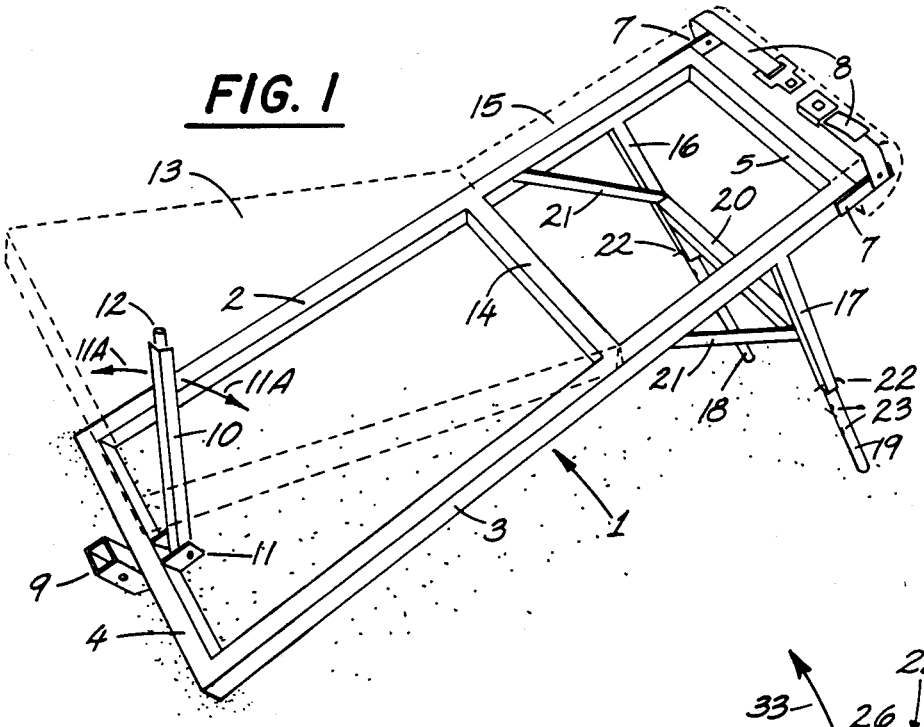
FIG. 1 is a perspective view of the metal framework of an abdominal exercise bench with the pads therefor shown in dash lines and embodying the invention.

Referring more particularly to the drawing by characters of reference, FIG. 1 discloses a rectangular metallic frame 1 which may be formed, for example, of welded tubular steel consisting of a pair of spaced side members 2 and 3 joined at one end by a cross member 4 and at the other end by a cross member 5. A pair of extensions 7 extending laterally outwardly of cross member 5 and parallel with side members 2 and 3 serve as points of attachment for seat belts 8.

Centered between its ends on the outboard face of rear end 4, and raising upwardly therefrom at substantially a 90° angle is welded a square tubular member 9 which is provided to receive various exercising attachments as hereinafter explained.

Figure 2:
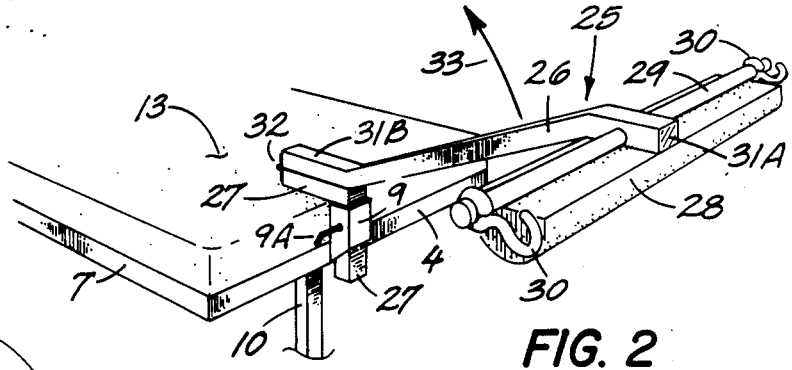
FIG. 2 is a perspective view of a biceps femoris exercising attachment and its method of attachment to the exercise bench shown in FIG. 1.
Figure 3:
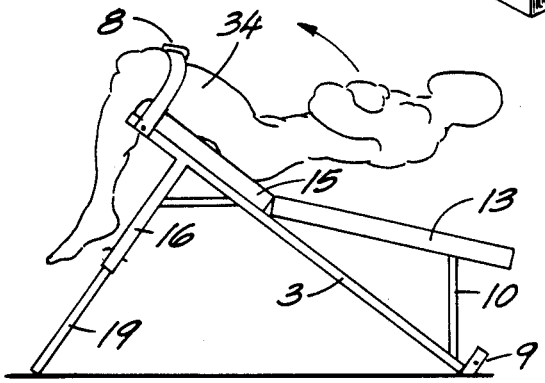
FIG. 3 is a side view of the exercise bench shown in FIG. 1 in use as an abdominal muscle exerciser.

As shown in FIG. 2, member 9 is pierced parallel to rearward end 4 for insertion of an exercise attachment retaining pin 9A. The lower end of member 9 is cut at an angle to prevent interference of it with the floor when the bench is used as an abdominal exercise device as shown in FIG. 3.

Opposite to member 9 on the other inboard parallel face of cross member 4 is mounted a support post 10 which is hingedly attached to a cleat 11 for arcuate movement as indicated by arrows 11A.

The free end of support post 10 culminates in an extension 12 having a rounded crown which is inserted into a hole bored in the underside of a pad 13 hingedly mounted on frame 1 for movement angularly thereof.

Pad 13, shown in dash lines in FIG. 1, is hingedly attached to a cross member 14 of frame 1 extending laterally between side members 2 and 3.

A further pad 15 is fixedly secured to the top side of frame 1 to extend outwardly of cross member 14 to cross member 5. Both pads 13 and 15 are constructed of a resilient plastic foam formed over a wooden or other rigid backing and covered with vinyl or other suitable durable material.

As shown in FIG. 1, a pair of tubular legs 16 and 17 are mounted to extend outwardly of frame 1 at a point between cross members 5 and 14 in a direction opposite to that of member 9 for receiving therein in a telescopic manner a pair of legs 18 and 19. A cross bar 20 is mounted to extend between legs 16 and 17 in a direction parallel to cross member 5.

Angle braces 21 are provided to extend between the ends of cross brace 20 and side members 2 and 3, as shown, to provide a rigid leg structure.

As shown in FIG. 1, legs 18 and 19 may be adjustably positioned in legs 16 and 17 by a pair of leg pins 22 which may be inserted through aligned openings or piercings 23 in legs 16 and 17 and similar openings in legs 18 and 19 along their lengths.

Thus, legs 18 and 19 may be easily slid into and out of legs 16 and 17 to angularly adjust the bench relative to supporting floor in a well known manner.

FIG. 2 shows a biceps femoris exercising attachment 25 inserted in tubular member 9. This attachment comprises a frame or support bar 26 having a mounting post 27 extending laterally therefrom which is inserted in tubular member 9. The support bar is formed to extend axially outwardly of cross member 4 for supporting perpendicularly thereof a leg pad 28 and a hook shaft 29. A pair of resistance hooks 30 are rotatably attached, one to each end of shaft 29.

Leg pad 28 is similar in construction to pads 13 and 15, and is rigidly affixed to the underside of the free end 31 of support bar 26 and hook shaft 29.

Figure 4:
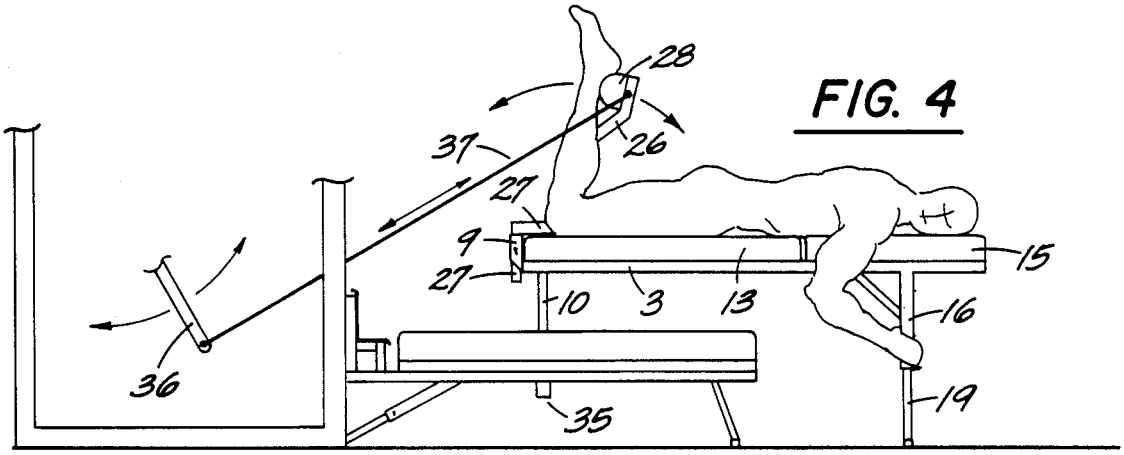
FIG. 4 is a side view of the exercise bench shown in FIG. 1 converted for use as a biceps femoris exerciser operating in conjunction with the exercise device disclosed in the above identified U.S. patent application Ser. No. 07/023,855.

Resistance hooks 30 serve to attach the exercise device disclosed to an external source of resistance via a rod, chain, rope, cable or other means as shown in FIG. 4. As shown, resistance hooks 30 are rotatably affixed to opposite ends of the steel hook shaft 29.

Support bar 26 is constructed of a single length of tubular steel having a square or rectangular cross-sectional configuration. As positioned in FIG. 2, it extends in a horizontal plane with its free ends 31A and 31B extending longitudinally of frame 1. When viewed in profile, free end 31A of support bar 26 is horizontal and straight for a distance equal to the width of leg pad 28. It then proceeds downwardly at a slight angle for a distance and then again assumes a horizontal position for a distance that is parallel to the free end 31A of the support bar 26 and culminating at a hinge 32.

As shown in FIG. 2, support bar 26 adjacent its free end 31A is through drilled laterally and midway of its length with a hole 33 for receiving therethrough hook shaft 29. This arrangement permits the upper face of leg pad 28 to remain in contact with and to be attached to hook shaft 29 along its entire length. The end 31B of support bar 26 is hingedly attached via hinge 32 to mounting post 27.

Mounting post 27 has the configuration of an inverted "L" with one leg joining the other at a 90° angle. As shown in FIG. 2, the underside of the hinged end of support bar 26 lies parallel to and in direct contact with the upper face of the horizontal leg of mounting post 27. In this manner, the horizontal leg of mounting post 27 serves as the stop and resting place for support bar 26. While downward motion of support bar 26 is prevented, support bar 26 is free to move arcuately as indicated by arrow 33 in FIG. 2.

With the vertical leg of mounting post 27 inserted into the accessary receiver, i.e. tubular member 9, it is rigidly affixed therein by pin 9A extending through a hole drilled in the vertical leg of the mounting post 27.

Mounting post 27 may be constructed of steel tubing having a square or rectangular cross-sectional configuration.

FIG. 3 shows the exercise bench formed by frame 1 in use as an abdominal exercising apparatus. The exerciser's lower body 34 is secured by seat belts 8 passing above the exerciser's knees. This is an improvement over prior art structures where awkward feet straps are utilized. Hinged pad 13 is held in the raised position by hinged support post 10. The raised position of hinged pad 13 prevents excess curvature of the spine which can result in permanent injury.

FIG. 4 illustrates the exercise bench in use as a biceps femoris exercising apparatus. Hinged support post or pin 10 is inserted into a receiver 35 creating a horizontal elevated platform for the exerciser to lie upon. Reference is made to the above identified patent application for a more detailed explanation of this type of device.

The exerciser then positions his or her body so that the knee joints are coincidental with hinge 32. With feet under leg pad 28, the exerciser repeatedly raises and lowers his or her feet, thereby exercising and developing the biceps femoris muscles.

As shown in FIG. 4, an external resistance 36 is provided from a source such as shown and embodied in the structure of the above identified patent application. It should be recognized, however, that other sources of resistance can be substituted for that shown in the identified patent application. The source of resistance 36 is linked to resistance hooks 30 via cables 37.

Although but a single embodiment of the invention has been illustrated and described, it will be apparent to those skilled in the art that various changes and modifications may be made therein without departing from the spirit of the invention or from the scope of the appended claims.

What is claimed is:

1. A multi-purpose exercise bench comprising:

an elongated frame having coplanar top and bottom surfaces and front and rear ends, a pair of ground engaging telescopically formed legs mounted adjacent the front end of said frame, a pivotally mounted support post mounted adjacent the rear end of said frame and movable to pivot laterally of each surface of said frame, pad means formed of front and rear portions, one of which is pivotally mounted with respect to the other for positioning on top of said frame, means for telescopically extending said front end of said frame relative to said rear end of said frame to position said frame angularly relative to its supporting surfaces, means for angularly positioning said support post to extend laterally of the top surface of said frame for supporting the rear portion of said pad means at a given angular position relative to said front end of said frame, said support post providing the dual function of angularly positioning said pad means above said top frame surface or extending from the bottom of the frame to provide support for the rear end of said frame, and belt means mounted on said front end of said frame for extending over the knees of an exerciser lying prone on said pad means during abdominal exercising activities.

2. The multi-purpose exercising bench set forth in claim 1 in further combination with:

a biceps femoris attachment for detachably mounting on said rear end of said frame means, said attachment comprising an elongated leg pad mounted to extend substantially parallel to said rear end of said frame at a predetermined distance therefrom and a support arm for said leg pad that is pivotally movable from a position substantially parallel with the top surface of said frame to a position extending angularly with the top surface of said frame, and resistance means connected to said leg pad for providing a control resistive force to the pivotal movement of said leg pad.

3. The multi-purpose exercising device set forth in claim 2 wherein:

said support post is pivotally mounted laterally of said bottom of said frame for supporting the rear of said frame in conjunction with said legs in a substantially horizontal position.

4. The multi-purpose exercising device set forth in claim 2 wherein:

said resistance means are pivotally connected to said pad means.

5. The multi-purpose exercising device set forth in claim 2 wherein:

said resistance means comprises a variable adjustable force that is pivotally connected to each end of said leg pad.

* * * * *